United States Patent [19]

Frederick

[11] 3,971,180

[45] July 27, 1976

[54] WALL STRUCTURE

[76] Inventor: Charles V. Frederick, Rte. No. 5, Box 132, New Virginia, Iowa 50210

[22] Filed: Oct. 25, 1974

[21] Appl. No.: 517,881

[52] U.S. Cl. ..... 52/251; 52/259; 52/293; 52/432; 52/437

[51] Int. Cl.[2] ..... E04B 1/16; E04B 2/34

[58] Field of Search ..... 52/630, 436–439, 52/585, 295, 293, 724, 725, 272–274, 234, 624, 429, 442, 432, 251, 259, 260

[56] References Cited

UNITED STATES PATENTS

| | | | |
|---|---|---|---|
| 1,045,519 | 11/1912 | Conzelman | 52/432 |
| 1,421,278 | 6/1922 | Matthews | 52/429 |
| 1,605,513 | 11/1926 | Connery | 52/630 |
| 2,116,946 | 5/1938 | Huntington | 52/429 |
| 2,366,108 | 12/1944 | Hitchins | 52/585 |
| 2,577,323 | 12/1951 | Goenner | 52/274 |
| 3,327,870 | 6/1967 | Fairchild | 52/634 |
| 3,387,421 | 6/1968 | Robertson | 52/436 |
| 3,521,420 | 7/1970 | Oliver | 52/624 |

FOREIGN PATENTS OR APPLICATIONS

| | | | |
|---|---|---|---|
| 961,229 | 11/1949 | France | 52/438 |
| 210,311 | 9/1940 | Switzerland | 52/725 |
| 557,353 | 11/1943 | United Kingdom | 52/438 |
| 1,074,652 | 7/1967 | United Kingdom | 52/432 |

*Primary Examiner*—Ernest R. Purser
*Assistant Examiner*—James L. Ridgill, Jr.
*Attorney, Agent, or Firm*—Zarley, McKee, Thomte & Voorhees

[57] ABSTRACT

The wall structure is comprised of a building panel which includes U-shaped side members each having a web portion and outwardly disposed spaced apart flange members with a plurality of sheet members extending between the web portions of the side members. The sheet members dwell in the same plane and the adjacent edges of the sheet members may be spaced from each other. Pairs of stiffener members extend between the side members on opposite sides of the sheet members and cover the adjacent edges of adjacent sheet members. The stiffener members have a beveled outer surface so that particulate material will not lodge thereon when the panel is in a vertical position. The stiffener members form an enclosed compartment along the adjacent edges of adjacent sheet members. A secured building panel of like description is aligned with the building panel just described so that the outwardly extending flanges of the panels are aligned to form a column compartment and the enclosed compartments formed by the stiffener members to create a rigid structural member with the panels. The panels are erected on a foundation base having a hollow sleeve element extending vertically downwardly thereinto below the column compartment. A reinforcing rod extend from the sleeve upwardly into the concrete within the column compartment. The method of erecting the panel members on the foundation base is also disclosed.

4 Claims, 8 Drawing Figures

WALL STRUCTURE

BACKGROUND OF THE INVENTION

This invention relates to a wall structure and the method of forming the same and more particularly to a building panel which is prefabricated and which may be assembled at the job site to create a wall structure.

Many types of prefabricated building panels have been previously described but the building panels of the prior art are either difficult to assemble, expensive to manufacture, or lack the necessary inherent strength.

Therefore, it is a principle object of the invention to provide an improved building panel.

A further object of the invention is to provide a wall structure and the method of forming the same.

A further object of the invention is to provide a building panel wherein stiffener members extend between a pair of side members on opposite sides of sheet members to form an enclosed compartment along the adjacent edges of the adjacent sheet members.

A further object of the invention is to provide a wall structure which has improved strength.

A further object of the invention is to provide a wall structure and the method of forming the same which is easily erected.

A further object of the invention is to provide a building panel having stiffener elements provided thereon which are designed to prevent material from lodging thereon when the panel is in a vertical position.

A further object of the invention is to provide a building panel which is economical of manufacture, durable in use and refined in appearance.

These and other objects will be apparent to those skilled in the art.

DESCRIPTION OF THE PREFERRED EMBODIMENT

Figure 1:
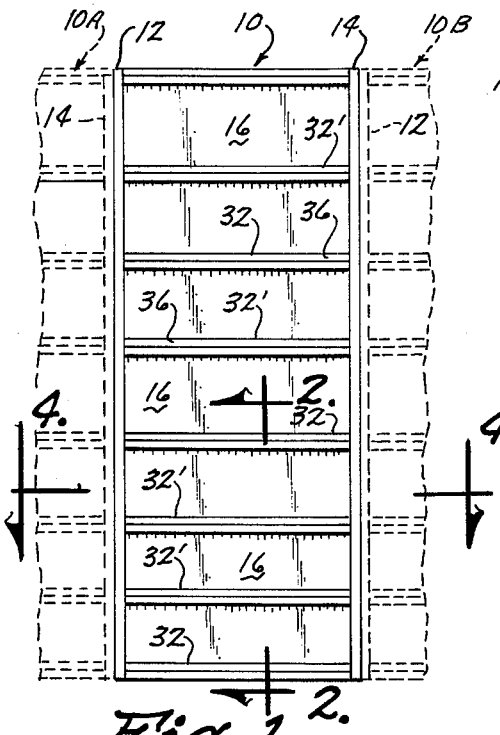
FIG. 1 is a side view of the building panel.
Figure 2:
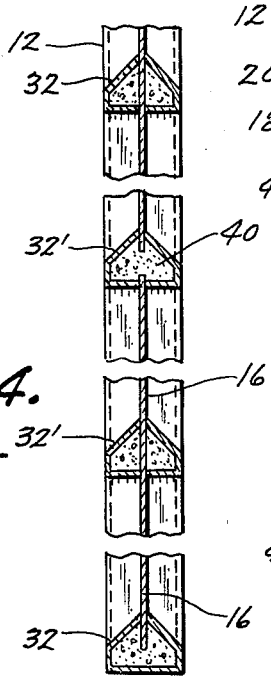
FIG. 2 is an enlarged partial sectional view as seen on lines 2—2 of FIG. 1.

The building panel of this invention is referred to generally by the reference numeral 10 and generally comprises U-shaped side members or channels 12 and 14 having a plurality of sheet members 16 secured thereto and extending therebetween.

Figure 3:
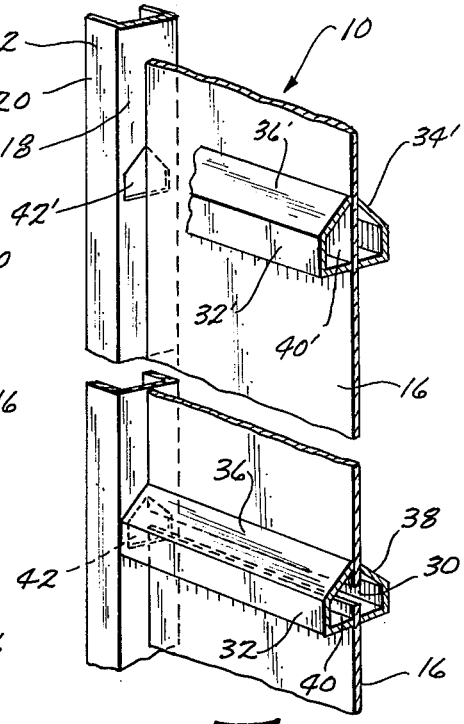
FIG. 3 is a partial perspective view of a portion of the building panel.

Side member 12 comprises a web portion 18 having outwardly disposed spaced a part flange members 20 and 22 extending therefrom as seen in the drawings. Likewise, side member 14 comprises a web portion 24 and outwardly disposed spaced apart flange members 26 and 28. As seen in FIG. 3 the sheet members 16 dwell in the same plane and have their adjacent edges spaced apart at 30. Stiffener members 32 and 34 are secured to and extend between side members 12 and 14 on opposite sides of the sheet members 16 and cover the adjacent edges of the adjacent sheet members as seen in the lower portion of FIG. 3. Stiffener members 32 and 34 are provided with outer beveled surfaces 36 and 38 respectively so that particulate material will not lodge thereon when the panel is in a vertical position. It can also be seen that the stiffener members at the lower portion of FIG. 3 form an enclosed compartment along the adjacent edges of the adjacent sheet members 16 and which will be referred to generally by the reference numeral 40.

Preferably, the side members 12 and 14 are provided with openings 42 formed in the web portions thereof which communicate with the ends of the stiffener elements and compartment 40 as illustrated in FIG. 3. If desired, auxiliary stiffener elements 32' and 34' may be secured to opposite sides of the sheet member 16 between the upper and lower edges thereof to add further strength and rigidity to the building panel. If the auxiliary stiffener members 32' and 34' are utilized, it is preferred that the side members 12 and 14 have openings 42' formed therein which communicate with the interior of the stiffener members 32' and 34' which is referred to generally by the reference numeral 40'.

Figure 4:
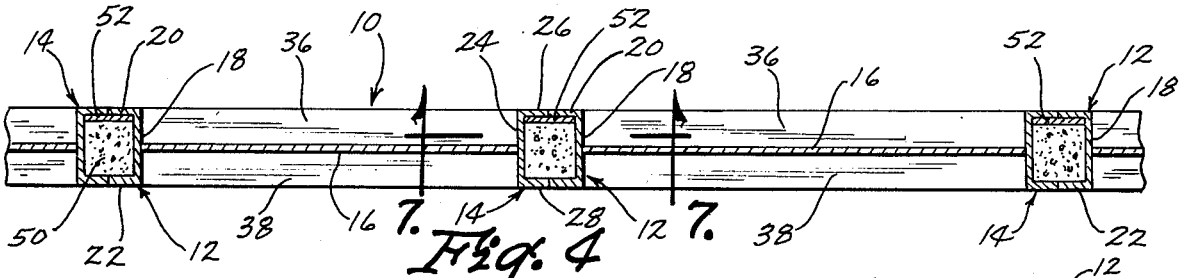
FIG. 4 is an enlarged sectional view as seen on lines 4—4 of FIG. 1.
Figure 5:
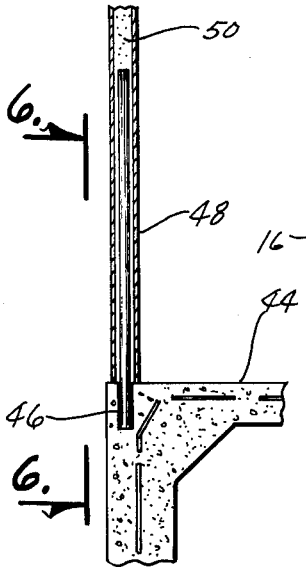
FIG. 5 is a sectional view illustrating the manner in which the building panel is secured to a foundation base.
Figure 6:
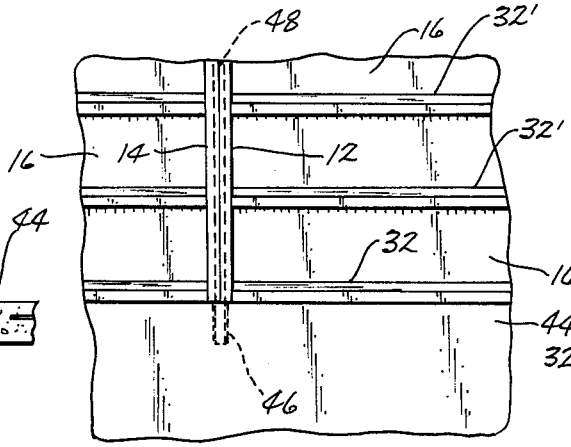
FIG. 6 is a view as seen on lines 6—6 of FIG. 5.
Figure 7:
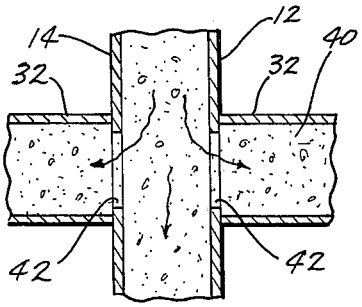
FIG. 7 is a sectional view seen on lines 7—7 of FIG. 4.
Figure 8:
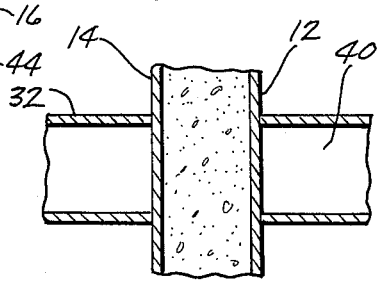
FIG. 8 is a sectional view similar to that seen in FIG. 7 except that the web portions do not have openings provided therein which communicate with the stiffener members.

Ordinarily, the building panels 10 are prefabricated at the factory and are transported to the job site by any convenient means. At the building or job site, a foundation base 44 is provided and which has a plurality of spaced apart sleeves 46 embedded therein. After the prefabrication of the building panels 10, 10A and 10B, the adjacent side members of adjacent panels are mounted over the sleeve 46 and a suitable reinforcing rod 48 is mounted in the sleeve so as to extend upwardly into the enclosed compartment 50 formed by the abutting side members 14 of one panel and side member 12 of the adjacent panel. FIG. 4 illustrates an extra reinforcing bar 52 which is secured to the inner surface of each outside column flange. The flanges of the abutting side members or channels are welded together and the resulting compartment 50 is filled with concrete. The filling of the compartment 50 with concrete also causes the concrete to move laterally outwardly into the compartments 40 and 40' defined by the stiffener elements if the openings 42 and 42' have been formed in the side members are channels. The operation is repeated until all of the building panels 10 have been installed to complete the enclosure.

Thus it can be seen that a novel building panel has been provided which may be prefabricated and which may be secured to identical building panels at the job site to form the building structure. The meeting or abbuting channels of the adjacent building panels are secured together and are filled with concrete to provide the necessary strength to the structure. The reinforcing rods mounted in the concrete in the compartments 50 also further strengthen the structure. The fact that the adjacent edges of adjacent sheet member 16 in the building panel 10 are spaced permits variation in the adjacent edges which makes the assembly of the building panel 10 a much easier operation. Thus it can be seen that the invention accomplishes at least all of the stated objectives.

I claim:

1. In a concrete, reinforceable metal building structure having metal building panels, comprising, a first panel of U-shaped metal side members each having a web portion and outwardly disposed spaced-apart flange members, said side members being oppositely disposed in a spaced-apart relation with the flanges thereof extending outwardly in opposite directions, a plurality of metal sheet members extending between said web portions and being secured thereto, and pairs of metal stiffener members extending between said side members on opposite sides of said sheet members and covering the adjacent edges of adjacent sheet members, said metal stiffener members having a beveled outer surface so that particulate material will not lodge thereon when said panel is in a vertical position; said stiffener members forming an enclosed compartment along the adjacent edges of adjacent sheet members, said webs having openings formed therein at the ends of said compartments, a second building panel of like description is aligned with said first panel so that the outwardly extending flanges of said panels are aligned to form a column compartment, and hardened concrete material positioned within said column compartments and the enclosed compartments formed by said stiffener members creating an interconnecting rigid structure member with said panels.

2. The building panel of claim 1 wherein the adjacent edges of said sheet members are spaced from each other.

3. The structure of claim 1 wherein a rigid reinforcing bar is located in the concrete of said column compartment.

4. The structure of claim 1 wherein said panels are erected on a foundation base, a hollow sleeve element extends vertically downwardly into said concrete base below said column compartment, and a reinforcing rod extends from said sleeve upwardly into the concrete within said column compartment.

* * * * *